United States Patent [19]

Ogan

[11] 4,364,678

[45] Dec. 21, 1982

[54] REINKABLE RIBBON CARTRIDGE

[75] Inventor: Robert M. Ogan, Gretna, La.

[73] Assignee: Telex Computer Products, Inc., Tulsa, Okla.

[21] Appl. No.: 228,071

[22] Filed: Jan. 26, 1981

Related U.S. Application Data

[63] Continuation of Ser. No. 61,844, Jul. 30, 1979, abandoned.

[51] Int. Cl.[3] ..... B41J 32/02; B41J 31/16

[52] U.S. Cl. ..... 400/202.2; 400/196.1; 400/234

[58] Field of Search ..... 400/196, 194, 196.1, 400/198–202.2, 234, 197

[56] References Cited

U.S. PATENT DOCUMENTS

| | | | |
|---|---|---|---|
| 2,699,245 | 1/1955 | Hernandez | 400/202 |
| 2,910,960 | 11/1959 | Markes | 400/202 |
| 3,400,801 | 9/1968 | Swenson | 400/202.2 |
| 3,621,968 | 11/1971 | Kondur, Jr. | 400/202 |
| 4,046,247 | 9/1977 | LaSpesa et al. | 400/202.2 |
| 4,091,913 | 5/1978 | Ku et al. | 400/196.1 |
| 4,213,715 | 7/1980 | Haftmann et al. | 400/196.1 |
| 4,300,847 | 11/1981 | Hoffman et al. | 400/196.1 |

FOREIGN PATENT DOCUMENTS

| | | | |
|---|---|---|---|
| 2550305 | 5/1977 | Fed. Rep. of Germany | 400/196.1 |

*Primary Examiner*—William Pieprz

*Attorney, Agent, or Firm*—Head, Johnson & Stevenson

[57] ABSTRACT

A ribbon cartridge for use in high speed cartridge type printers, in which the ribbon is enclosed in the cartridge, and the entire cartridge must move at extremely high speeds. The cartridge is in a generally U-shaped case with the base of the U comprising a ribbon storage volume. One of the arms of the U is called the exit arm, and the other called the re-entry arm. Positive pressure roller means is provided for driving the ribbon into the storage volume, thereby pulling ribbon out of the storage volume at the other end, out through the exit arm where a pad of felt, or the like, is used to provide suitable tension. The ribbon then moves across between the two tips of the U arms, down and into the re-entry arm. An ink reservoir is provided in the re-entry arm, comprising a wedge of felt or similar material and including means to apply marking fluid, such as stamp pad ink, to the wedge. There is a strip of felt pressing with one side against the wedge reservoir, and the re-entering ribbon presses against and moves along the other side of the strip, taking up ink, and replenishing the ink on the ribbon to compensate for that used in the printing operation.

1 Claim, 1 Drawing Figure

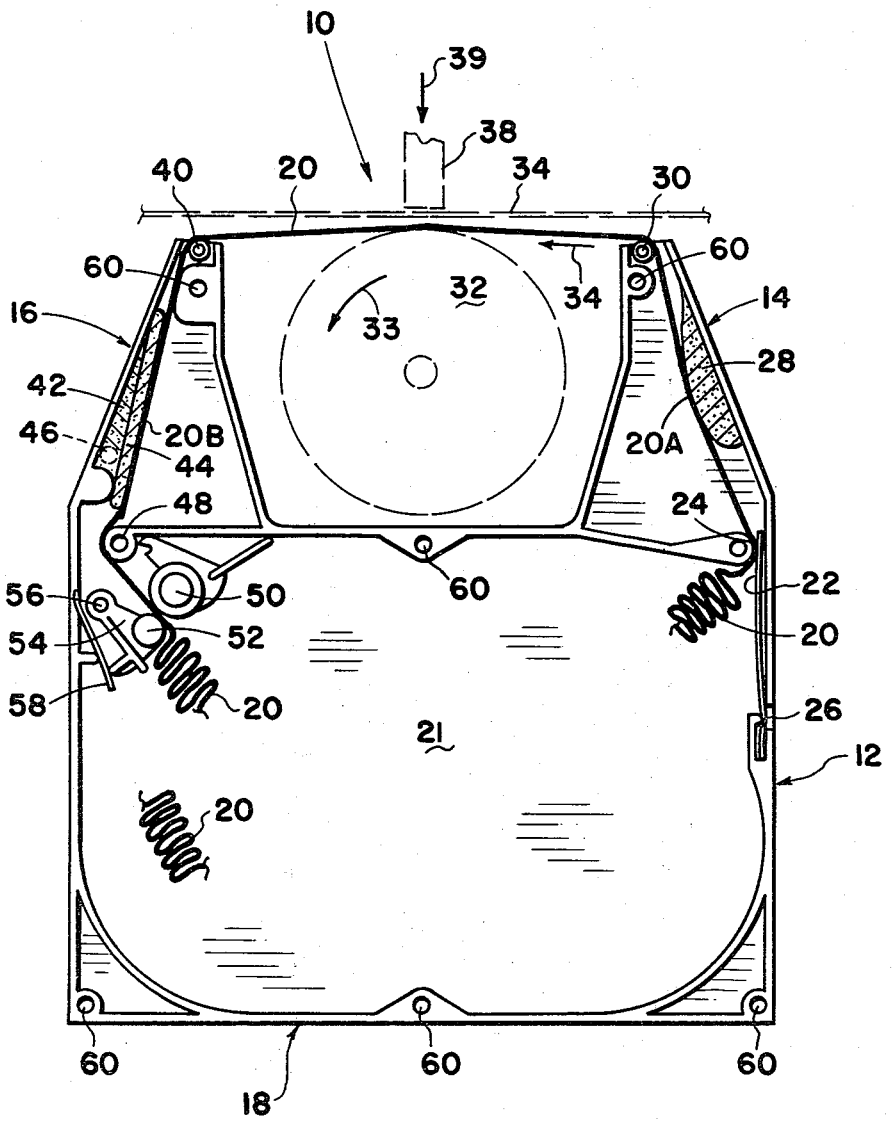
10
39
38
40
20
34
30
60
60
32
34
14
16
33
28
42
46
20B
44
20A
48
24
56
50
60
22
54
52
20
58
20
26
21
12
20
60
60
60
18

REINKABLE RIBBON CARTRIDGE

This is a continuation application of Ser. No. 61,844, filed July 30, 1979 now abandoned.

BACKGROUND OF THE INVENTION

I. Field of the Invention

This invention lies in the field of fast printing mechanisms for computers and the like. More particularly it concerns a type of ribbon cartridge which can be mounted in a printing mechanism and which is adapted to move rapidly across a sheet of printing medium in close association with a print wheel and hammer, such that selected characters can be printed from the wheel to the medium as the carriage containing the wheel and ribbon cartridge move at high speed across the medium.

II. Description of the Prior Art

In the prior art, printers have been designed with reinking systems which usually consist of a bottle of suitable marking fluid, or ink, and a means of wicking the ink from the bottle to the ribbon. In spool type ribbon feed systems, such designs are feasable because the ribbon can easily be moved across the wick with the bottle remaining stationary.

On the other hand in high speed cartridge type printers the ribbon is enclosed in a cartridge and the entire cartridge must move at extremely high slewing speeds. Because of the weight and the possiblity of spilling ink, bottle type reinking systems are not feasible.

SUMMARY OF THE INVENTION

It is the primary object of this invention to provide a modified ribbon cartridge in which a continuous loop of ribbon can be stored, and from which it is withdrawn through an exit arm, passing across to and through a re-entry arm, and is forced back into the storage volume by means of pressure roller drive means.

The principal driving force for the movement of the ribbon is the pressure roller drive means, which is in a wall separating the re-entry arm from the ribbon storage volume. In forcing the ribbon into the storage volume it pulls ribbon down into the re-entry arm, and the tension in the ribbon causes new sections of the ribbon to be pulled out of the storage volume and to move out of the exit arm, and across from the tip of the exit arm to the tip of the re-entry arm. The ribbon in this position closes the top of the U-shaped cartridge.

The cartridge would be positioned around a printwheel which would fit into the enclosed area of the U, and the ribbon would be in position between the type wheel, or printing wheel, and the printing medium, with a suitable electro-magnetically operated hammer means provided on the opposite side of the printing medium. Thus with the wheel turned to a selected position, so that a selected character is in position against the medium, operation of the hammer would then press the printing medium against the inked ribbon and would thus print that character.

The improvement in the inking mechanism is, to provide a suitable pad of fibrous material such as felt, along and against which the ribbon would move outward from the storage area through the exit arm, and so on. Similarly, on the re-entry arm a reservoir of ink or marking fluid is provided, by a wedge of felt or suitable porous material which is held in place against the wall of the case, by a strip of felt, or other porous material, against the side of which the ribbon is held and moves on its way to the pressure roller means and to the storage volume. From the ink reservoir ink passes through the felt strip, and is picked up by the ribbon, because of the pressure contact as it moves along the strip. A small opening through one wall of the case permits reapplying ink to the ink reservoir, by means such as an eye dropper, or the like.

BRIEF DESCRIPTION OF THE DRAWING

These and other objects and advantages of this invention and a better understanding of the principles and details of the invention will be evident from the following description taken in conjunction with the appended drawing, in which the FIGURE represents a plan view of a modified and improved reinking ribbon cartridge, shown without the cover.

DESCRIPTION OF THE PREFERRED EMBODIMENT

Referring now to the drawing, there is shown a plan view of one embodiment of this invention, which is a reinkable ribbon cartridge. This is indicated generally by the numeral 10. It comprises a case indicated generally by the numeral 12, which is generally in the shape of a U. The wide base portion 18 of the U comprises a storage volume indicated by the numeral 21.

There is an outlet 24 from the storage volume 21 by means of which the ribbon 20 can be withdrawn. The ribbon 20 passes out through one of the arms of the U, called an exit arm 14. The path of the ribbon 20A is configured so that it presses against, and moves along a pad 28 of felt or other fibrous material, held against the case. This movement of the ribbon against the felt pad provides sufficient friction, so that no excess ink from the ink reservoir is left on the ribbon as it is withdrawn from the storage volume 21. Friction is also provided by spring 22 pressing ribbon 20 against opening 24.

The ribbon then goes over a roller surface 30 and across to the tip of the second arm 16 of the U and round a similar roller 40. In this second arm, which is the re-entry arm 16, there is an ink reservoir 42 which comprises a pad of fibrous material such as felt, which is held in place against the wall of the case by a strip 44 of felt, or other suitable porous material. In moving into the storage volume the ribbon presses against, and moves along the surface of this strip 44. Ink from the reservoir pad 42 passes through the porous strip 44 and is picked up by the ribbon 20B in its movement along the strip 44.

The ribbon them moves to the pressure roller drive means which comprises a roller 50 which is driven by suitable mechanism, and a pressure roller 52, mounted on arm 54 which is hinged at point 56. Arm 54 is pressed by means of spring 58 into strong pressure contact with the roller 50. The action of the rotation of roller 50 and the pressure contact of 52 forces the ribbon 20 into the storage space 20.

Shown inside the arms of the U by the dashed circle 32, is a printing wheel which has suitable characters embossed along its rim. The ribbon 20 passes across the edge of the printing wheel 32 and a strip or sheet of printing medium 34 which might be a sheet or strip of paper, for example, is held just out of contact with the ribbon 20. A hammer 38 driven by electro-magnetic solenoid means, is indicated by the dashed outlet 38. When the print wheel 32 is rotated into a selected position, and a selected character is in contact with the ribbon, the hammer 38 is moved downwardly in accordance with arrow 38 to print that character on the under surface of the printing medium 34.

A small opening 46 through one surface of the case, drilled in an appropriate position, in contact with the ink reservoir pad 42 permits applying a suitable volume of ink to the pad 42, which is transmitted through the felt pad 44 to the ribbon 20B passing along the surface of the strip 44.

Experience with an ink ribbon cartridge modified as shown in the figure, has shown that the life of usable sharpness of the ink printing has been extended from three weeks of operation to thirty weeks of operation, by the reinking means just described.

The design of the case 12, print wheel 32, hammer 38 and drive means 50, 52, form no part of this invention. The invention as described in the claims comprises the pad tensioning means 28, the ink reservoir means 42, ink transfer means 44, and means 46, for the addition of marking fluid to the ink reservoir.

The cover of the case is not shown but consists of a plate of the same shape as the case 12. The cover has a plurality of short pins so positioned as to fit into the openings 60, for relative alignment, etc.

While the invention has been described with a certain degree of particularity, it is manifest that many changes may be made in details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed is:

1. In a unitary, self-contained ribbon cartridge for use in a printing device for printing information on a sheet or strip of paper, comprising:

(a) a thin flat case having a general U-shaped configuration, the base of said U having a storage space for storing said ribbon in a continuous loop;

(b) one of the arms of said U being an exit arm, and the other arm being a re-entry arm;

(c) pressure roller drive means for withdrawing the ribbon from said storage space, out through said exit arm, across the open ends of said arms, and into and through said re-entry arm, where said pressure roller drive means forces said ribbon into said storage space;

the improvement in means for continuously reinking said ribbon while in use, comprising;

(d) a stationary ink absorbing reservoir strip in said re-entry arm comprising a pad of porous material such as felt;

(e) a separate stationary ink transfer strip of felt or similar porous material, positioned with one side against said ink reservoir, the re-entering ribbon adapted to move against and along the opposite side of said ink transfer strip, the case having an opening in the wall there adjacent said ink absorbing reservoir strip whereby a liquid marking fluid may be added to said ink absorbing reservoir strip to be absorbed thereby whereby ink is transferred from said reservoir strip to said transfer strip and to said ribbon, and (f) an excess ink removing of felt or similar fibrous material, against and along which the inked side of said ribbon rubs while moving out of said exit arm.

* * * * *